US006344708B1

(12) United States Patent
Foo

(10) Patent No.: US 6,344,708 B1
(45) Date of Patent: Feb. 5, 2002

(54) ENERGY SAVING LAMP WITH PLASTIC BASE

(75) Inventor: Onn Fah Foo, Kowloon (HK)

(73) Assignee: Mass Technology (H. K.) Ltd., Kowloon (HK)

( * ) Notice: Subject to any disclaimer, the term of this patent is extended or adjusted under 35 U.S.C. 154(b) by 0 days.

(21) Appl. No.: 09/354,579

(22) Filed: Jul. 16, 1999

(30) Foreign Application Priority Data

Jul. 18, 1998 (EP) ..... 98113440

(51) Int. Cl.[7] ..... H01J 5/60

(52) U.S. Cl. ..... 313/318.04; 313/318.01; 313/318.09; 313/318.11

(58) Field of Search ..... 313/318.04, 318.01, 313/318.09, 318.11, 113, 25, 315; 362/221, 265

(56) References Cited

U.S. PATENT DOCUMENTS 4,392,076 A * 7/1983 Ishler et al. ..... 313/318
5,221,140 A * 6/1993 Oshino ..... 362/255
5,550,722 A * 8/1996 Bouwman et al. ..... 362/221
5,747,919 A * 5/1998 Gandhi et al. ..... 313/318.01

FOREIGN PATENT DOCUMENTS

| | | |
|---|---|---|
| EP | 0583034 | 2/1994 |
| GB | 2151841 | 7/1985 |

* cited by examiner

*Primary Examiner*—Ashok Patel
*Assistant Examiner*—Ken A . Berck
(74) *Attorney, Agent, or Firm*—Dennison, Scheiner & Schultz

(57) ABSTRACT

An electric lamp, especially energy saving lamp, comprising a discharge tube, a lamp head or socket extending into a rear cover in which an electronic ballast for operating a discharge tube is arranged at least partly, said lamp head having a first and second contact connected to the ballast, and the lamp head comprises a screw plastic part covered at the external surface with a layer of conductive metal film providing the first contact, a contact-point plastic part connected to the end of the screw plastic part, and a metal contact-point fixed at the center of the rear end of the contact-point plastic part providing the second contact.

19 Claims, 6 Drawing Sheets

ENERGY SAVING LAMP WITH PLASTIC BASE

The invention relates to an electric lamp, especially energy saving lamp, comprising a discharge tube, a lamp head or socket extending into a rear cover in which an electronic ballast for operating a discharge tube is arranged at least partly, said lamp head having a first and second contact connected to the ballast.

BACKGROUND OF THE INVENTION

An existing integral energy saving lamp is composed of four parts, namely, a low pressure discharge tube, an electronic ballast, a rear cover and a lamp head. Among them, the lamp head is connected to the lower end of the rear cover. The lamp head is made of metal material, so that it will fit the common lamp socket. However, the screw thread of the lamp head is formed by mold-roll. Therefore, the accuracy of the screw size is not high, the uniformity is poor, and there is 10% below standard in the production (sometimes even up to 30%), so the production cost rises. And more, for the sake of reducing the volume of the energy saving lamp, some of the electronic ballast elements are placed inside the space of the lamp head. However, the lamp head is made of metal conductor and is electrified due to the connection to the power supply, and it is difficult to conform to safety certification demands for the household appliances.

SUMMARY OF THE INVENTION

An object of the present invention is to provide an electric lamp, especially an energy saving lamp with a kind of lamp head with high accuracy of screw size, reducing lamp volume, high production yield and lower radio disturbance voltage.

This object is achieved according to the invention by a lamp head comprising a screw plastic part covered at the external surface with a layer of conductive metal film providing the first contact, a contact-point plastic part connected to the end of the screw plastic part, and a metal contact-point fixed at the center of the rear end of the contact-point plastic part providing the second contact.

In an embodiment of the invention the screw plastic part is covered with a layer of conductive metal film on the internal surface.

In another embodiment of the invention the three parts—the lamp head screw plastic part, the contact-point plastic part and the metal contact-point are riveted together.

In a further embodiment of the invention the three parts are made either individually or integrally through plastic-injection of the lamp head screw plastic part and the rear cover of the energy saving lamp as well as the contact-point plastic part.

Compared to the existing energy saving lamp, the advantages of the new one are: due to the plastic injection formation, the accuracy of the size of the screw is high, the uniformity is good. It overcomes the disadvantages of low accuracy of the size of the screw due to metal mold-roll formation, the poor uniformity, and the low production yield. It raises the production yield. Because of the insulation of the plastic part of the lamp head, the space inside the lamp head is isolated from the external surface conductive metal film. It plays the part of electricity insulation. By doing so, if a ballast element is preferably placed inside the lamp head, it will satisfy the safety certification demands. It reduces the volume of the energy saving lamp. Since a coupling capacitance is formed between the element inside the lamp head and screw metal film, the practical fact proves that once the overall arrangement of the element and the wiring is reasonable, not only the harmful coupling is eliminated, but also the coupling capacitance can be used to reduce the conductive disturbance. The lamp head is conformable with E37, E26, E14 and E12 of the IEC Standard.

BRIEF DESCRIPTION OF THE DRAWINGS

Further advantages, characteristics and details of the invention will become apparent not only from the claims and the characteristics learned from them—either alone and/or in combination—but also from the following description of a preferred embodiment in conjunction with the drawings.

DETAILED DESCRIPTION OF THE PREFERRED EMBODIMENTS

Figure 1:
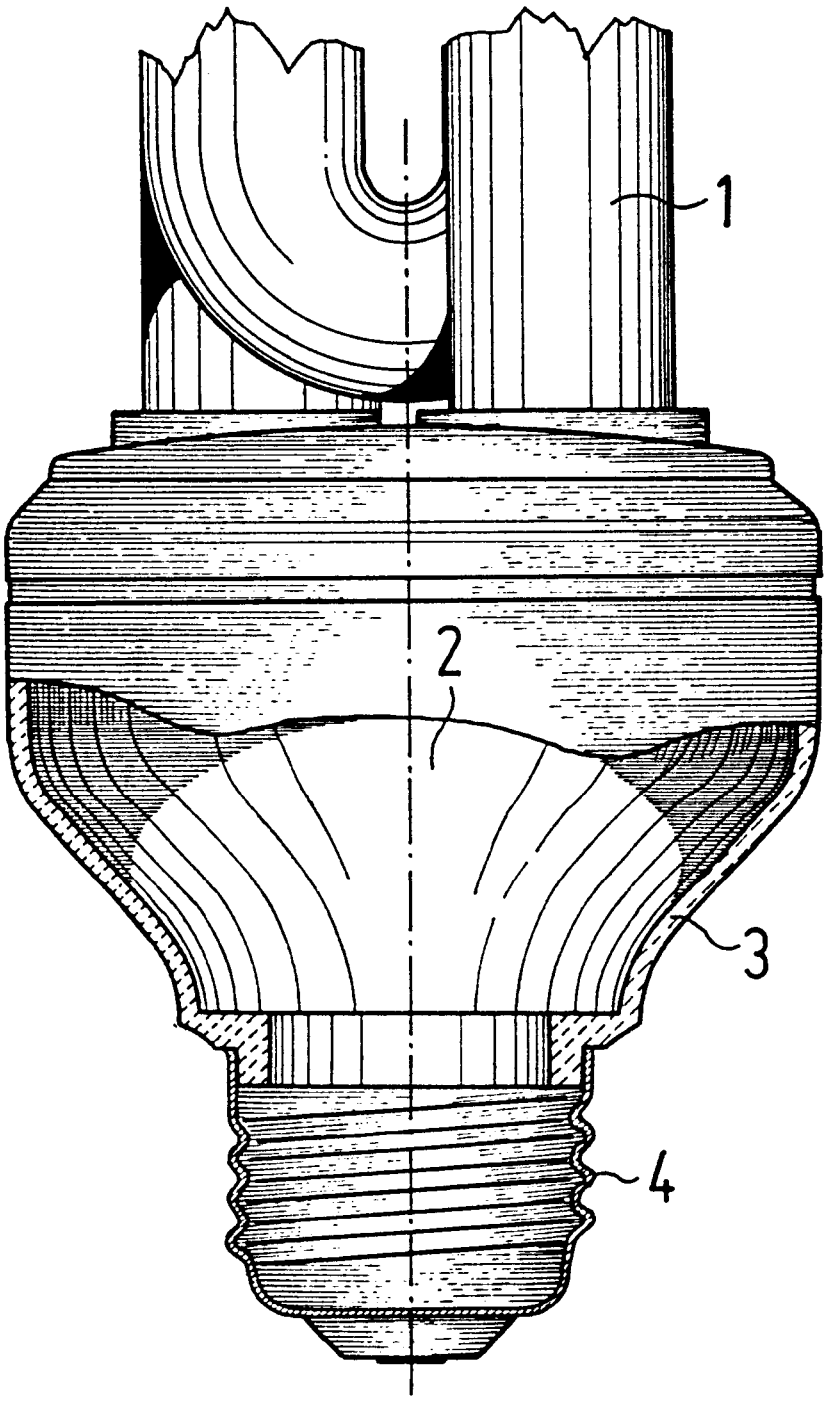
FIG. 1 shows the structure of a lamp head of an existing electric energy saving lamp in side view, partly in cross-section.

As shown in FIG. 1, the existing integral energy saving lamp is composed of a tube 1, an electronic ballast 2, a rear cover 3 or housing and a lamp head 4 or socket. Among them, the lamp head is made of metal material.

Figure 2:
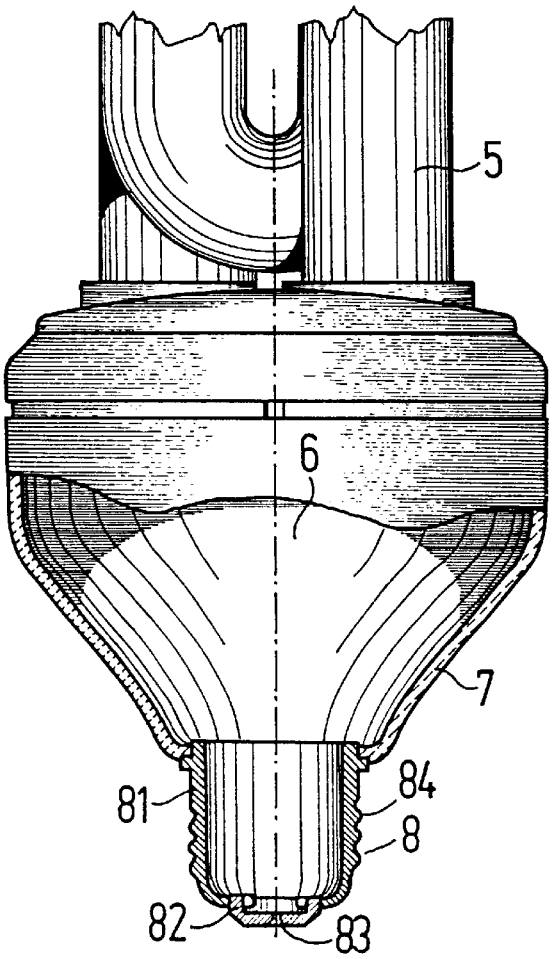
FIG. 2 shows the structure of the lamp head for an electric energy saving lamp according to the invention in side view, partly in cross-section.

As shown in FIG. 2, the energy saving lamp according to the invention is composed of a tube 5, an electronic ballast 6, a plastic rear cover 7 or housing of the energy saving lamp and a lamp head 8 or cap or socket. The lamp head 8 consists of the lamp head screw plastic part 81, a contact-point plastic part 82 and a metal contact-point 83. There is a layer of conductive metal film 84 with a thickness of 0.6 $\mu$m on the external or outer surface, or on both the inner or interior and outer surfaces or side walls of the lamp head 8. It can be made with a selected metal galvanization technology on the plastic surface. This layer of metal film provides a connection to an external power supply. The contact-point plastic part 82 is connected to the end of the screw plastic part 81 on the lamp head 8. The metal contact-point 83 is fixed at the center of the rear end of the contact-point plastic part 82. It is better to use an integral plastic injection of the three parts—the lamp head screw plastic part 81, the rear cover 7 of the energy saving lamp and the contact-point plastic part 82. Then the metal contact-point is fixed as riveted onto the contact-point plastic part 82.

Figure 3:
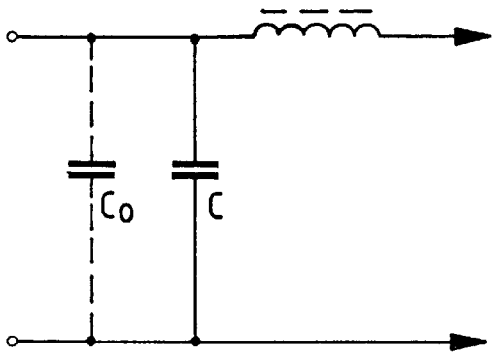
FIG. 3 shows an elementary circuit diagram referring to the reduction of the conductive disturbance of the lamp head of the energy saving lamp according to the present invention.

That an element of the electronic ballast is placed inside the above mentioned lamp head space can conform to the safety certification demands (for details, see Deutsche Industrie-norm DIN 57721). The common metal lamp head is not up to the standard. Since the element of the electronic ballast is placed inside the lamp head, and the capacitance is formed between the element and the lamp head screw metal film 84, the problem of the increasing of the conductive disturbance does not occur. The practice proves that if the reasonable overall arrangement of the ballast element and wiring is adopted, especially if the location of the filter inductor is correct, the harmful coupling is possibly completely eliminated. Oppositely, the coupling capacitance can be used to reduce the conductive disturbance. FIG. 3 gives out the normal filter circuit reducing the conductive disturbance in the electronic ballast. Herewith, the capacitance $C_o$ is the above said coupling capacitance. It plays the part of the by-pass capacitance at the power input terminal. Obviously, it can reduce the conductive disturbance.

Figure 4:
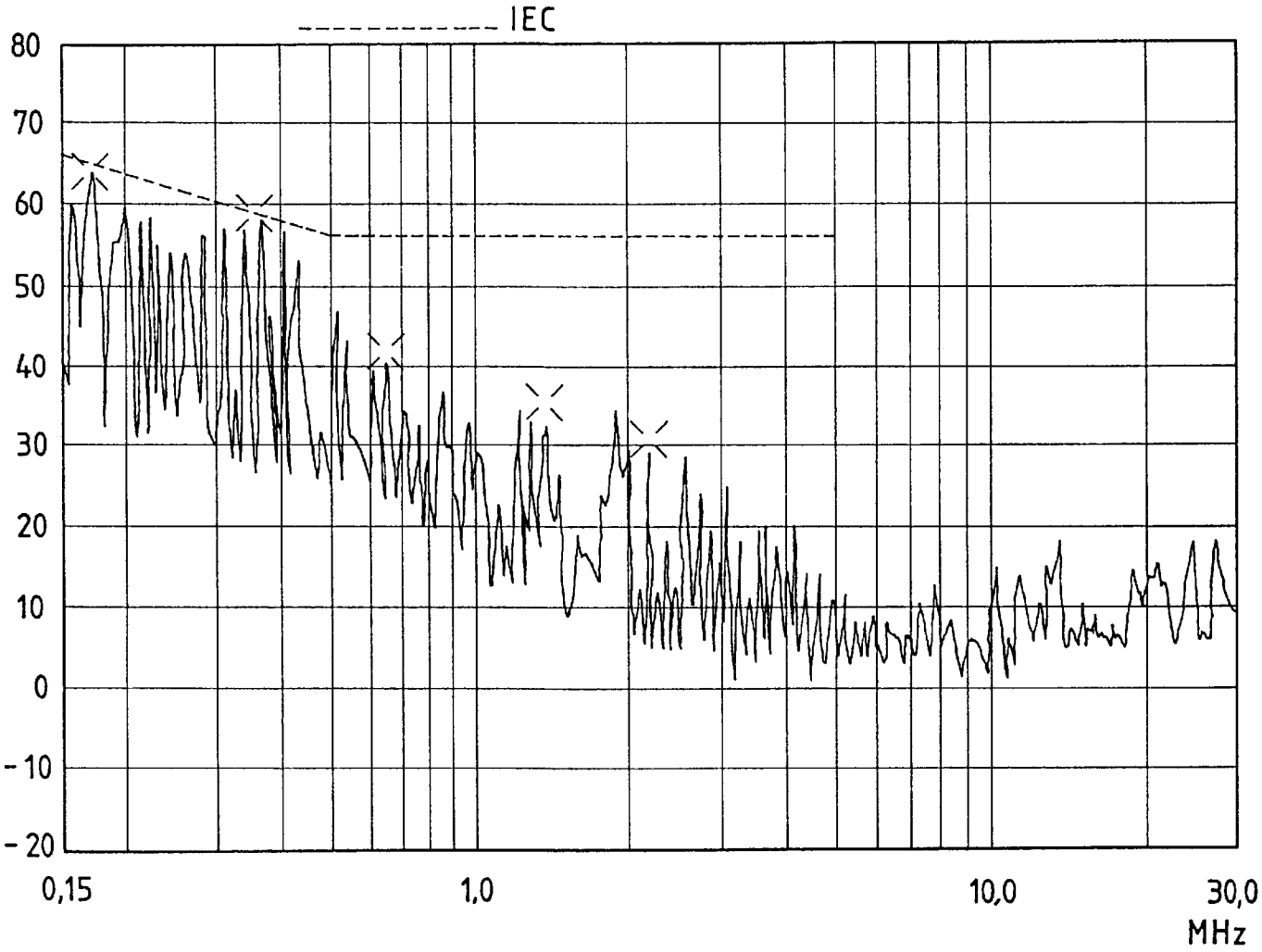
FIG. 4 shows a frequency spectrum of the conductive disturbance in accordance with the stipulation of CISPR of radio conductive disturbance without a ballast element placed inside the lamp head.

FIG. 4 shows a frequency spectrum of a normal lamp cap manufactured by LEXAN ELECTRONIC & LIGHTING (XLAMEN) CO., LTD. Operation condition was 25° C. The test specimen was W15W, 220–240 V, 50/60 Hz, E24, 2700 K. The measurement was made with a Rohde & Schwarz EM I Receiver. ESPC, in accordance with the stipulation of CISPR (International Special Commitee on Radio Interference). The power of the interference is indicated on the vertical axis.

Figure 5:
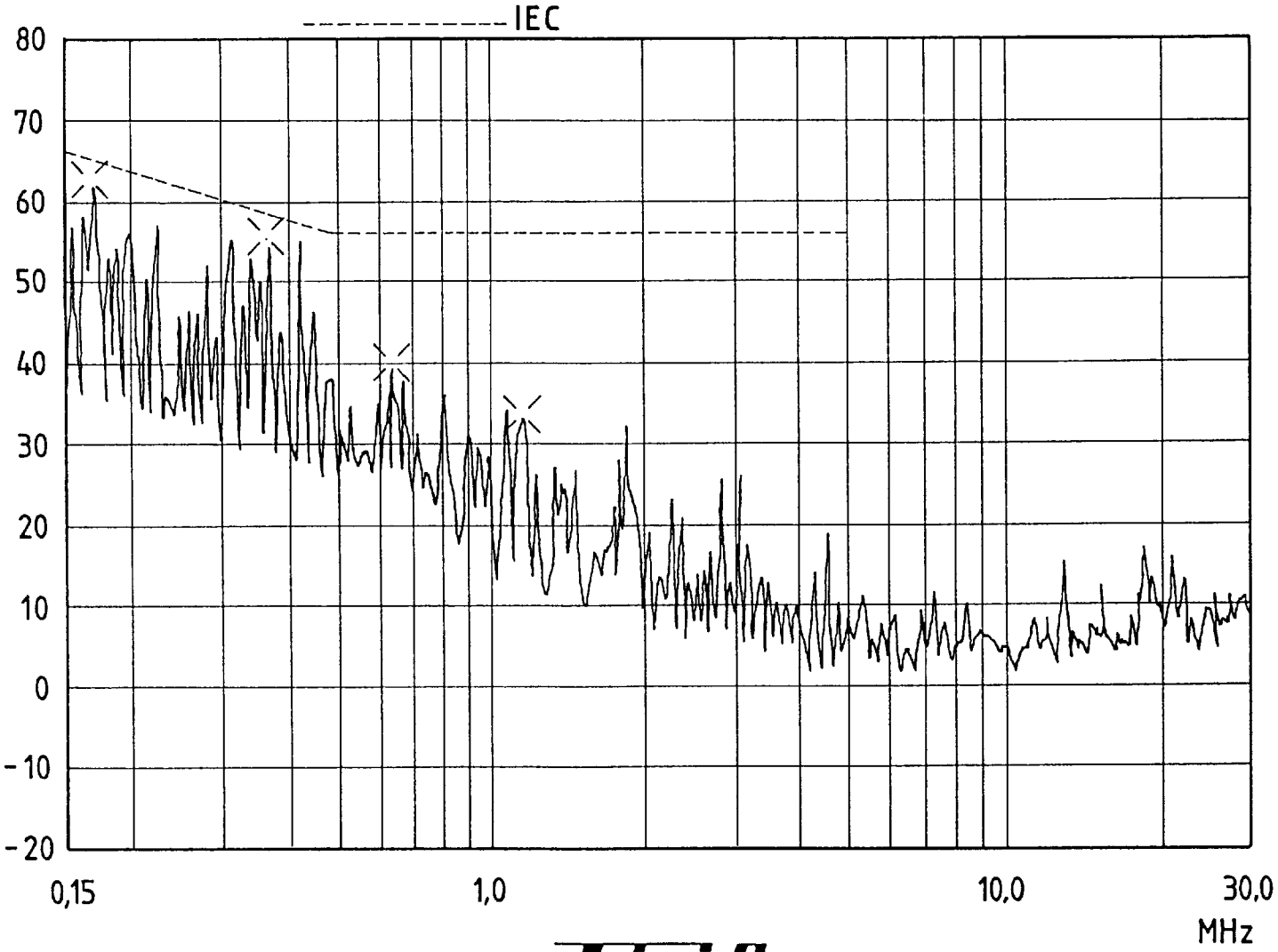
FIG. 5 shows a frequency spectrum of the conductive disturbance in accordance with the stipulation of CISPR of radio conductive disturbance with a ballast element placed inside the lamp head.

FIG. 5 shows a frequency spectrum of a plastic lamp head or lamp cap according to the invention manufactured by LEXAN ELECTRONIC & LIGHTING (XINMEN) CO., LTD. Operation condition was 25° C. The test specimen was W 15W, 220–240 V, 50/60 Hz, E 24, 2700 K. The measurement was made with a Rohde & Schwarz EM I Receiver. ESPC, in accordance with the stipulation of CISPR. The power of the interference is indicated on the vertical axis. The frequency is plotted on the horizontal axis in MHz.

Figure 6:
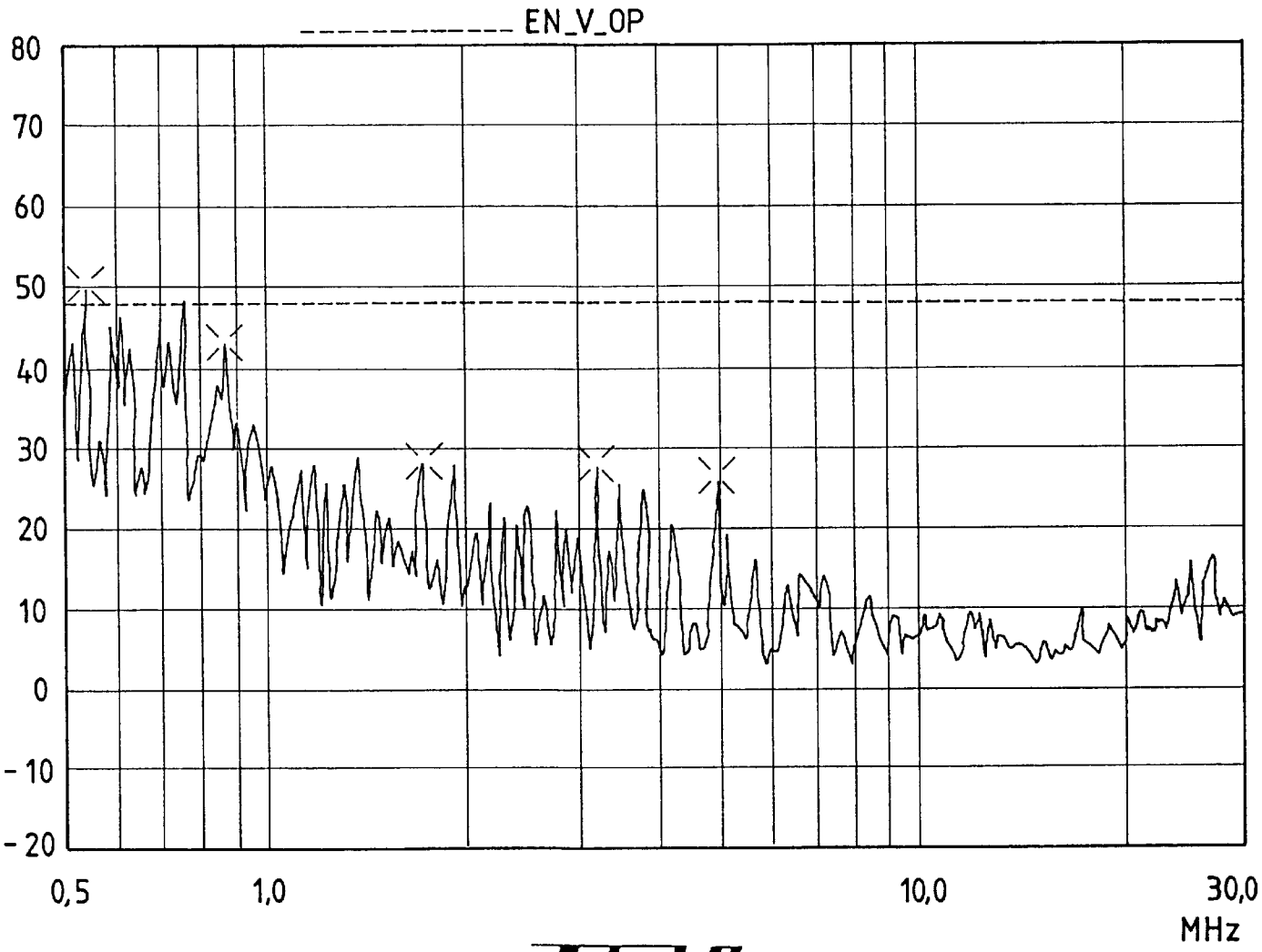
FIG. 6 shows a frequency spectrum of the conductive disturbance in accordance with the stipulation of FCC of radio conductive disturbance without a ballast element placed inside the lamp head.

FIG. 6 shows the frequency spectrum (power versus frequency) of the normal lamp cap as mentioned above according to the stipulation of FCC (Federal Communications Commission).

Figure 7:
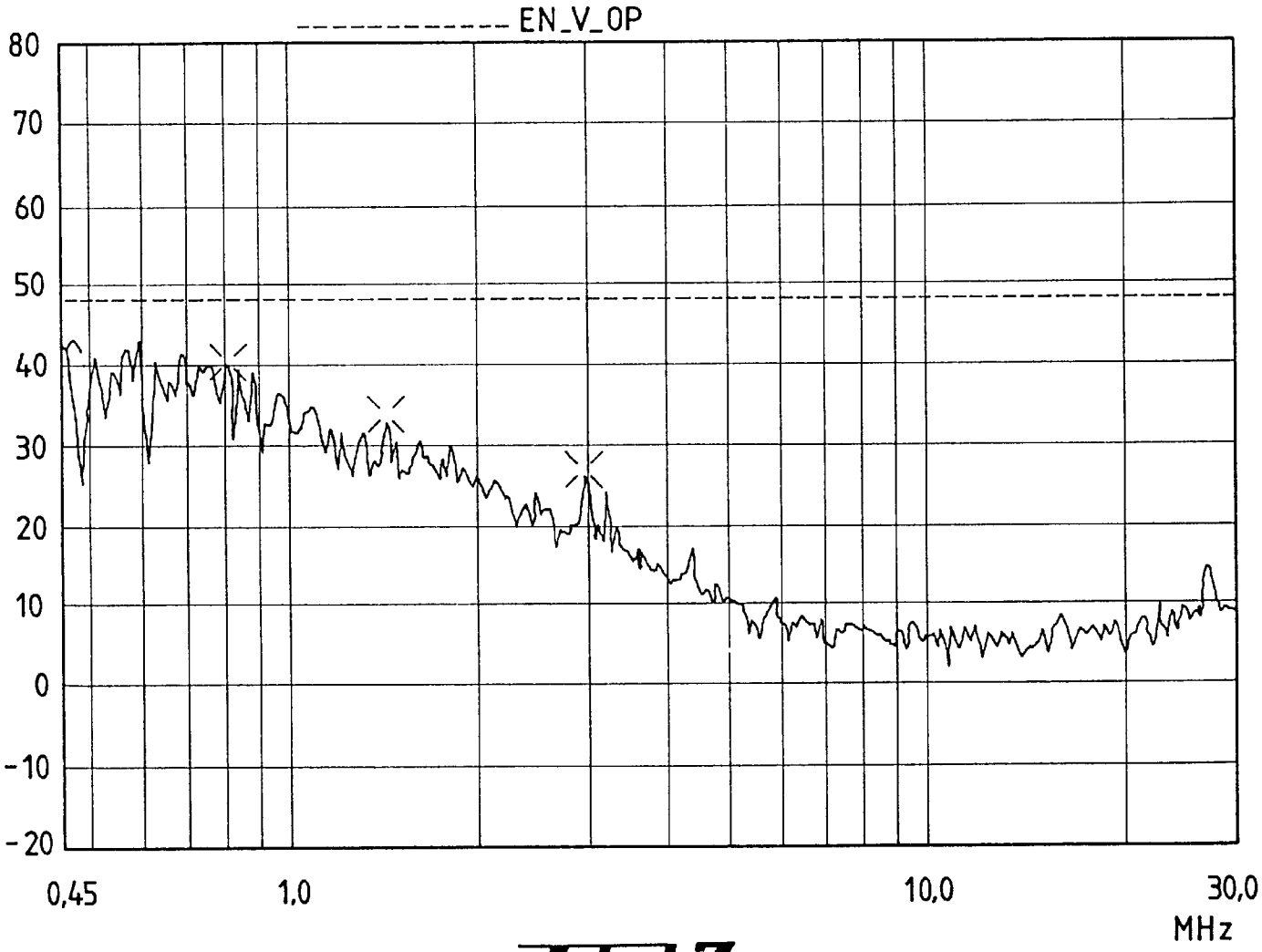
FIG. 7 shows a frequency spectrum of the conductive disturbance in accordance with the stipulation of FCC of radio conductive disturbance with a ballast element placed inside the lamp head.

FIG. 7 shows power versus frequency of the lamp head or lamp cap of the present invention according to the stipulation of FCC.

From the data in FIGS. 4–7 it can be learned that the reduction due to the present invention is about 3 dB.

What is claimed is:

1. An electric lamp, comprising a discharge tube (5), a lamp head (8) or socket extending into a rear cover (7) in which an electronic ballast (6) for operating a discharge tube is arranged, said lamp head (8) having a first and second contact (83, 84) connected to the ballast, characterized in that the lamp head (8) comprises a screw plastic part (81) covered at the external surface with a layer of conductive metal film (84) providing the first contact, a contact-point plastic part (82) connected to the end of the screw plastic part (81), and a metal contact-point (83) fixed at the center of the rear end of the contact-point plastic part (82) providing the second contact, wherein the screw plastic part (81) is covered with a layer of conductive metal film (84) on the internal surface.

2. An electric lamp, comprising a discharge tube (5), a lamp head (8) or socket extending into a rear cover (7) in which an electronic ballast (6) for operating a discharge tube is arranged, said lamp head (8) having a first and second contact (83, 84) connected to the ballast, characterized in that the lamp head (8) comprises a screw plastic part (81) covered at the external surface with a layer of conductive metal film (84) providing the first contact, a contact-point plastic part (82) connected to the end of the screw plastic part (81), and a metal contact-point (83) fixed at the center of the rear end of the contact-point plastic part (82) providing the second contact, wherein the conductive metal film (84) on the outer surface of the screw plastic part (81) has a thickness in the range of 0.3 to 1.2 $\mu$m.

3. An electric lamp according to claim 1, characterized in that the conductive metal film (84) on the inner surface of the screw plastic part (81) has a thickness in the range of 0.3 to 1.2 $\mu$m.

4. An electric lamp according to claim 1, characterized in that the conductive metal film is made of nickel and copper.

5. An electric lamp, comprising a discharge tube (5), a lamp head (8) or socket extending into a rear cover (7) in which an electronic ballast (6) for operating a discharge tube is arranged, said lamp head (8) having a first and second contact (83, 84) connected to the ballast, characterized in that the lamp head (8) comprises a screw plastic part (81) covered at the external surface with a layer of conductive metal film (84) providing the first contact, a contact-point plastic part (82) connected to the end of the screw plastic part (81), and a metal contact-point (83) fixed at the center of the rear end of the contact-point plastic part (82) providing the second contact, wherein the metal film covers an area of the outer surface of the screw plastic part (81) in the range of 1000 to 3000 $mm^2$, and/or the metal film (84) covers an area of the inner surface of the screw plastic part (81) in the range of 1000 to 3000 $mm^2$.

6. An electric lamp, comprising a discharge tube (5), a lamp head (8) or socket extending into a rear cover (7) in which an electronic ballast (6) for operating a discharge tube is arranged, said lamp head (8) having a first and second contact (83, 84) connected to the ballast, characterized in that the lamp head (8) comprises a screw plastic part (81) covered at the external surface with a layer of conductive metal film (84) providing the first contact, a contact-point plastic part (82) connected to the end of the screw plastic part (81), and a metal contact-point (83) fixed at the center of the rear end of the contact-point plastic part (82) providing the second contact, wherein the screw plastic part (81), the contact-point plastic part (82) and the metal contact-point (83) are riveted together.

7. An electric lamp, comprising a discharge tube (5), a lamp head (8) or socket extending into a rear cover (7) in which an electronic ballast (6) for operating a discharge tube is arranged, said lamp head (8) having a first and second contact (83, 84) connected to the ballast, characterized in that the lamp head (8) comprises a screw plastic part (81) covered at the external surface with a layer of conductive metal film (84) providing the first contact, a contact-point plastic part (82) connected to the end of the screw plastic part (81), and a metal contact-point (83) fixed at the center of the rear end of the contact-point plastic part (82) providing the second contact, wherein the screw plastic part (81) and the contact-point plastic part (82) are integral plastic injection parts.

8. An electric lamp, comprising a discharge tube (5), a lamp head (8) or socket extending into a rear cover (7) in which an electronic ballast (6) for operating a discharge tube is arranged, said lamp head (8) having a first and second contact (83, 84) connected to the ballast, characterized in that the lamp head (8) comprises a screw plastic part (81)

covered at the external surface with a layer of conductive metal film (84) providing the first contact, a contact-point plastic part (82) connected to the end of the screw plastic part (81), and a metal contact-point (83) fixed at the center of the rear end of the contact-point plastic part (82) providing the second contact, wherein the screw plastic part (81), the contact-point plastic part (82) and the rear cover (7) are integral plastic injection parts.

9. An electric lamp according to claim 1, characterized in that a coil or capacitor of the electronic ballast is placed inside the lamp head (8).

10. An electric lamp according to claim 1 wherein the conductive metal film (84) on the outer surface of the screw plastic part (81) has a thickness in the range of 0.3 to 1.2.

11. An electric lamp according to claim 1 wherein the conductive metal film (84) on the inner surface of the screw plastic part (81) has a thickness in the range of 0.3 to 1.2 $\mu$m.

12. An electric lamp according to claim 2 wherein the conductive metal film is made of nickel and copper.

13. An electric lamp according to claim 12 wherein the screw plastic part (81), the contact-point plastic part (82) and the metal contact point (83) are riveted together.

14. An electric lamp according to claim 13 wherein the screw plastic part (81) and the contact-point plastic part (82) are integral plastic injection parts.

15. An electric lamp according to claim 13 wherein the screw plastic part (81) the contact-point plastic part (82), and the rear cover (7) are integral plastic injection parts.

16. An electric lamp according to claim 15 wherein a coil or capacitor of the electronic ballast is placed inside the lamp head (8).

17. An electric lamp according to claim 10 wherein the screw plastic part (81) and the contact-point plastic part (82) are integral plastic injection parts.

18. An electric lamp according to claim 10 wherein a coil or capacitor of the electronic ballast is placed inside the lamp head (8).

19. An electric lamp according to claim 11 wherein a coil or capacitor of the electronic ballast is placed inside the lamp head (8).

* * * * *

UNITED STATES PATENT AND TRADEMARK OFFICE

CERTIFICATE OF CORRECTION

PATENT NO. : 6,344,708 B1
DATED : February 5, 2002
INVENTOR(S) : Onn Fah Foo

It is certified that error appears in the above-identified patent and that said Letters Patent is hereby corrected as shown below:

Column 5,
Line 14, should read:
-- plastic part (81) has a thickness in the range of 0.3 to 1.2 μm. --

Signed and Sealed this

Thirteenth Day of January, 2004

JON W. DUDAS
*Acting Director of the United States Patent and Trademark Office*